US007237466B2

(12) United States Patent
Chen

(10) Patent No.: US 7,237,466 B2
(45) Date of Patent: Jul. 3, 2007

(54) CARRIER BRAIDING MACHINE WITH GUIDING DEVICE

(76) Inventor: Ming-Cheng Chen, No.55, Lane 278, Haiwei Rd., Longjing Township, Taichung County 434 (TW)

( * ) Notice: Subject to any disclaimer, the term of this patent is extended or adjusted under 35 U.S.C. 154(b) by 0 days.

(21) Appl. No.: 11/246,179

(22) Filed: Oct. 11, 2005

(65) Prior Publication Data

US 2007/0051232 A1 Mar. 8, 2007

(51) Int. Cl.
*D04C 3/00* (2006.01)

(52) U.S. Cl. ..... 87/33

(58) Field of Classification Search ..... 87/33, 87/43–51

See application file for complete search history.

(56) References Cited

U.S. PATENT DOCUMENTS 4,621,560 A * 11/1986 Brown et al. ..... 87/8
5,301,596 A * 4/1994 Huey, Jr. ..... 87/8
5,931,077 A * 8/1999 DeYoung ..... 87/44
6,598,510 B1 * 7/2003 Kim ..... 87/33

* cited by examiner

*Primary Examiner*—Shaun R. Hurley
(74) *Attorney, Agent, or Firm*—Rosenberg, Klein & Lee

(57) ABSTRACT

A guiding device for a carrier braiding machine is mounted on a cover of the machine and comprises a center guide member and an outer guide member. The transfer plates are located between the center guide member and the outer guide member and the inner and outer guide members limit the support plates of the carrier so that the eccentric force cannot push the carrier away from the transfer plates. The contact between the support plates of the carrier and the guide members also reduces the torque and sped of the carrier so that the carrier is protected.

4 Claims, 4 Drawing Sheets

CARRIER BRAIDING MACHINE WITH GUIDING DEVICE

FIELD OF THE INVENTION

The present invention relates to a guiding device for retaining movement of support plates of carriers of carrier braiding machine to prevent the carriers from dropping due to eccentric force.

BACKGROUND OF THE INVENTION

A conventional braiding machine 1 is shown in FIG. 1 and generally includes base 11 with a plurality of gears 13 received therein and each gear 13 includes a shaft connected thereto, and a cover 12 which is mounted onto the base 11 and the shafts of the gears 13 extend through holes in the cover 12. The shafts of the gears respectively connected to a transfer plate 14 and each transfer plate 14 includes a plurality of notches 141. A carrier 15 is rotatably located on the cover 12 and includes a support mechanism 152 on a side of the shaft 151 of the carrier 15 and a weaving mechanism 153 on the other side of the shaft 151. The support mechanism 152 includes two support plates 154 which are located on the upper and bottom surface of the transfer plates 14. The gears 13 drive the transfer plates 14 to rotate so that the carrier 15 is driven to rotate around the transfer plates 14. However, due to the high speed of rotation of the transfer plates 14, the carriers 15 which are applied by an eccentric force have a tendency to fly out from the transfer plates 14. There is no other object provided to prevent the carriers 15 from flying away from the transfer plates 14 so that the gears 13 have to be set at a slower speed and eventually the efficiency of braiding is lowered. The support plates 154 of the carrier 15 grind the transfer plates 14 when the carrier 15 is applied by an eccentric force and the friction generates a torque to cause the shaft 151 damaged.

The present invention intends to provide a guiding device for retaining the movement of the support plates on the carrier so that the carrier can be operated at high speed without the worry of the eccentric force.

SUMMARY OF THE INVENTION

The present invention relates to a carrier braiding machine which comprises a base with a transmission device received therein and a cover is mounted on the base. A plurality of transfer plates are located on the cover and driven by the transmission device. Each of the transfer plates has a plurality of notches. A carrier is driven by the transfer plates and has a shaft. A support mechanism is connected on a side of the shaft of the carrier and a weaving mechanism is connected on the other side of the shaft. The support mechanism includes two support plates which are located on an upper surface and a bottom surface of the transfer plates. A guiding device is mounted above the cover and includes a center guide member and an outer guide member. The transfer plates are located between the center guide member and the outer guide member and the support plates are movably engaged with the center guide member and the outer guide member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
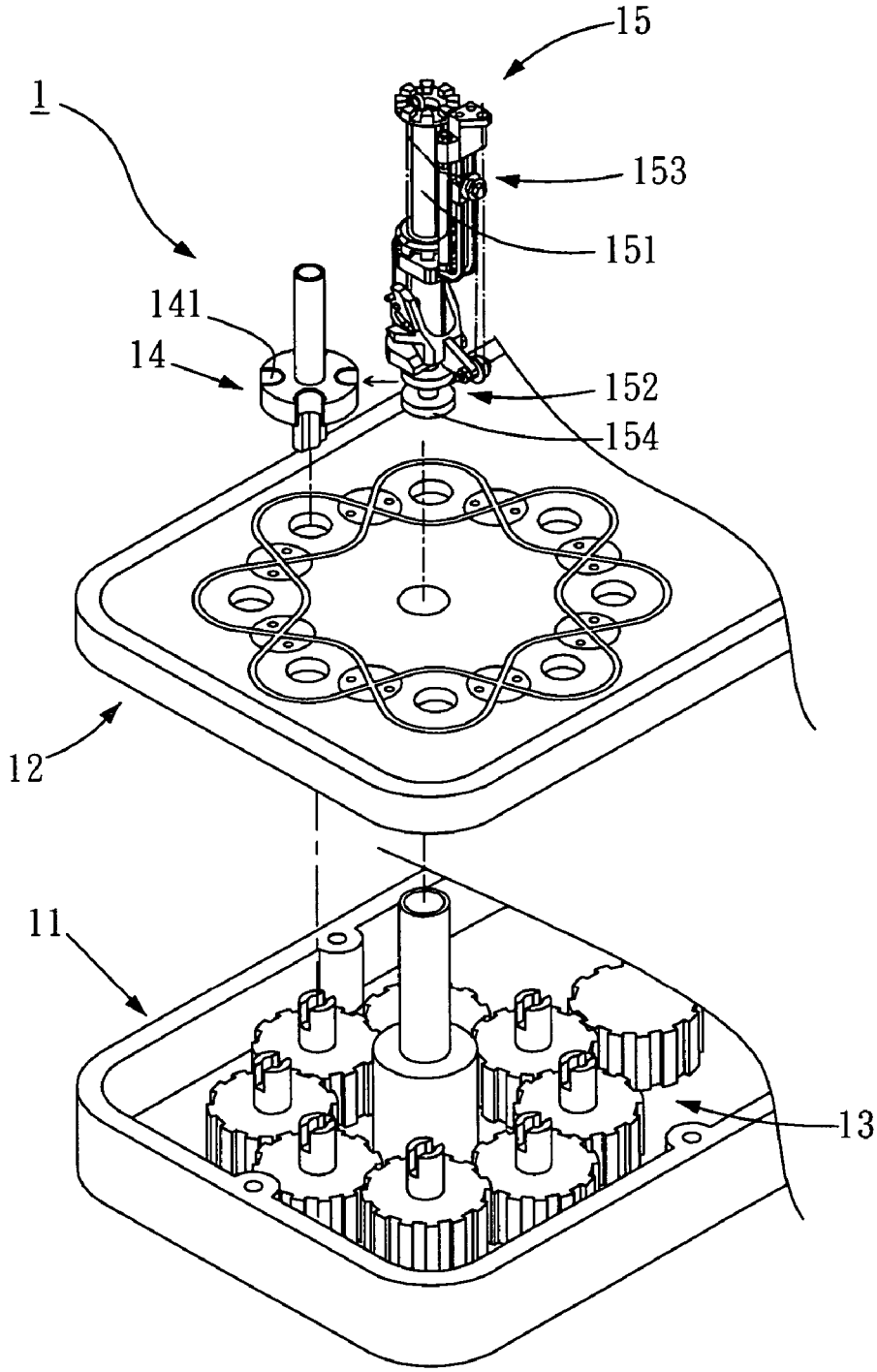
F I G . 1 (PRIOR ART)
FIG. 1 is an exploded view to show a conventional carrier braiding machine.
Figure 2:
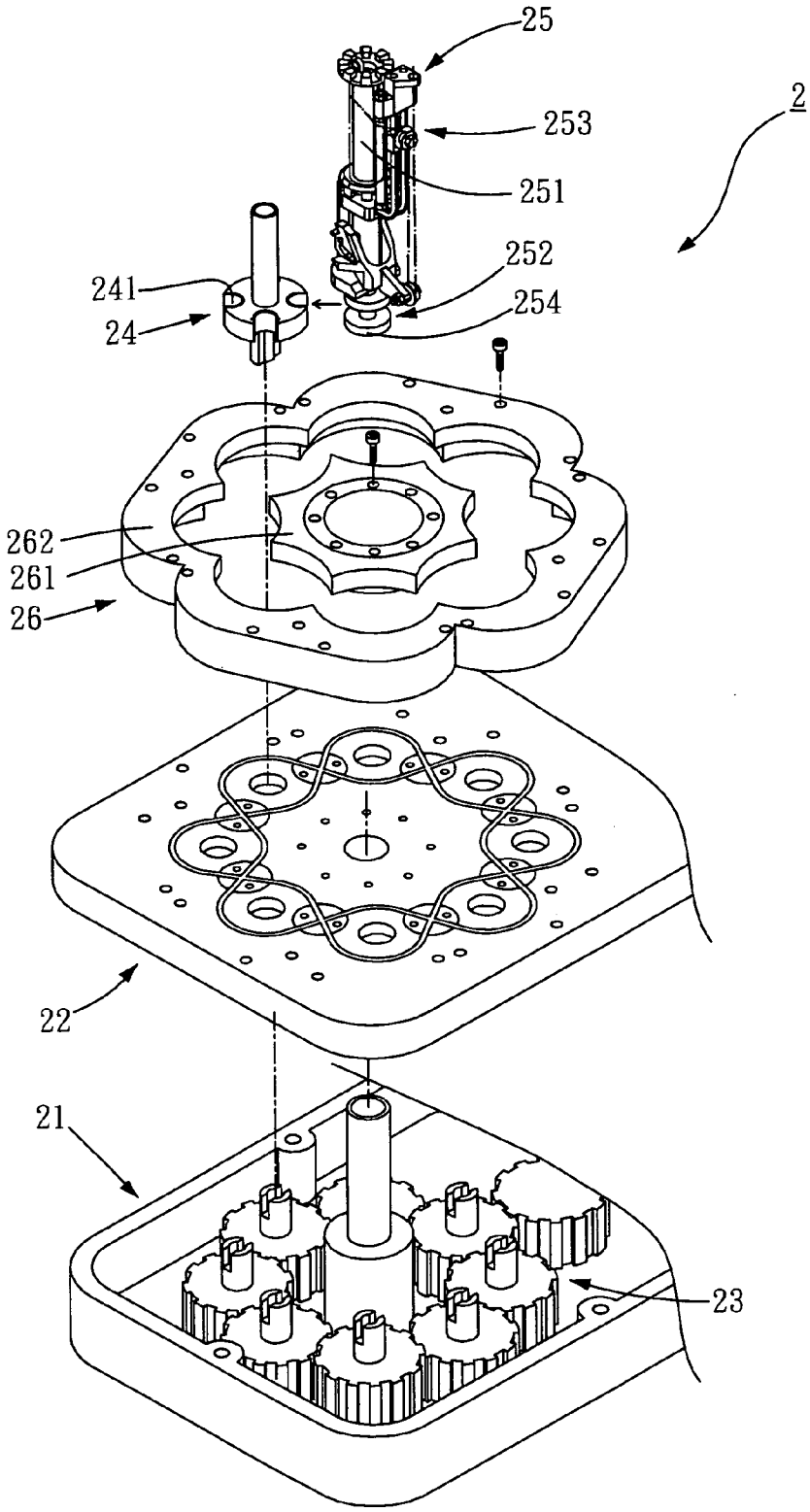
FIG. 2 is an exploded view to show the carrier braiding machine of the present invention.
Figure 3:
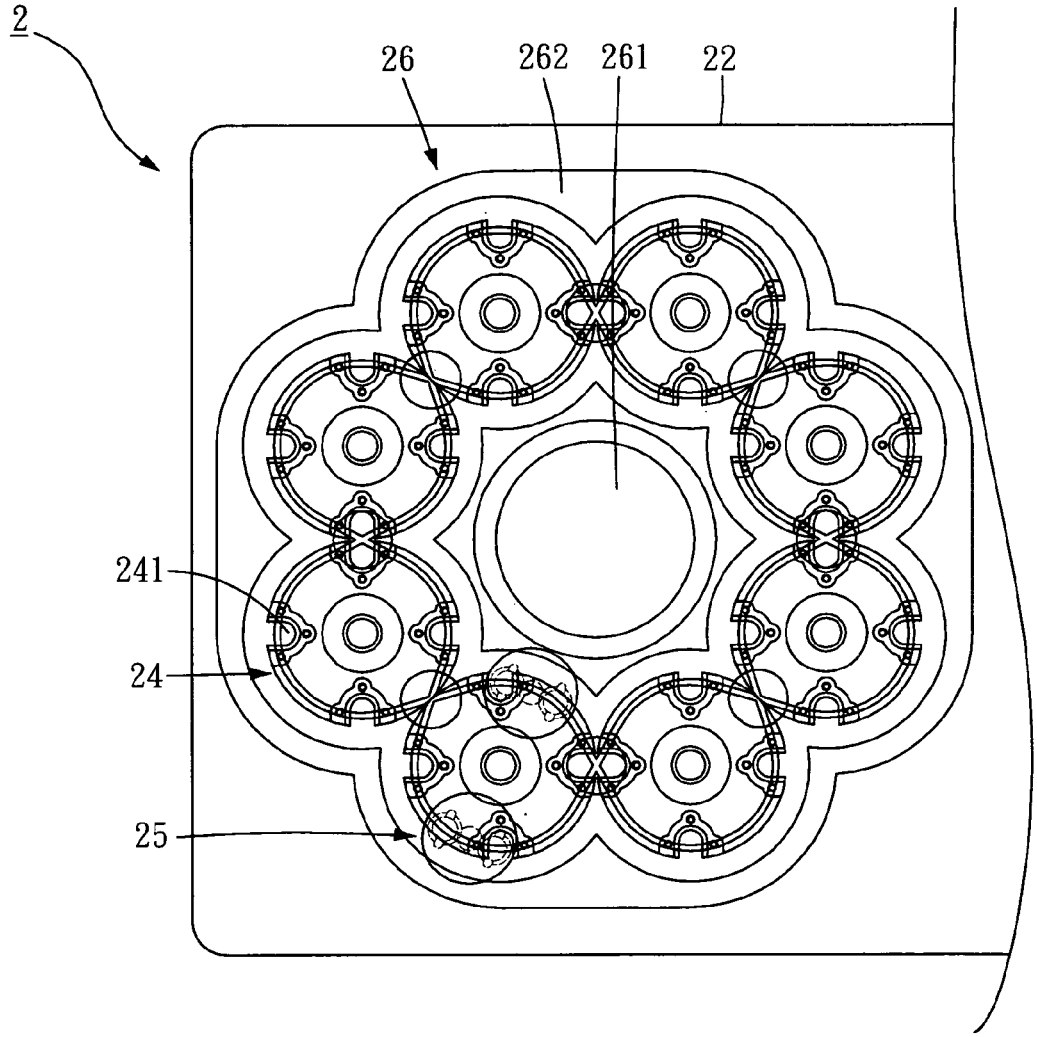
FIG. 3 is a top view to show the carrier driven by the transfer plates.
Figure 4:
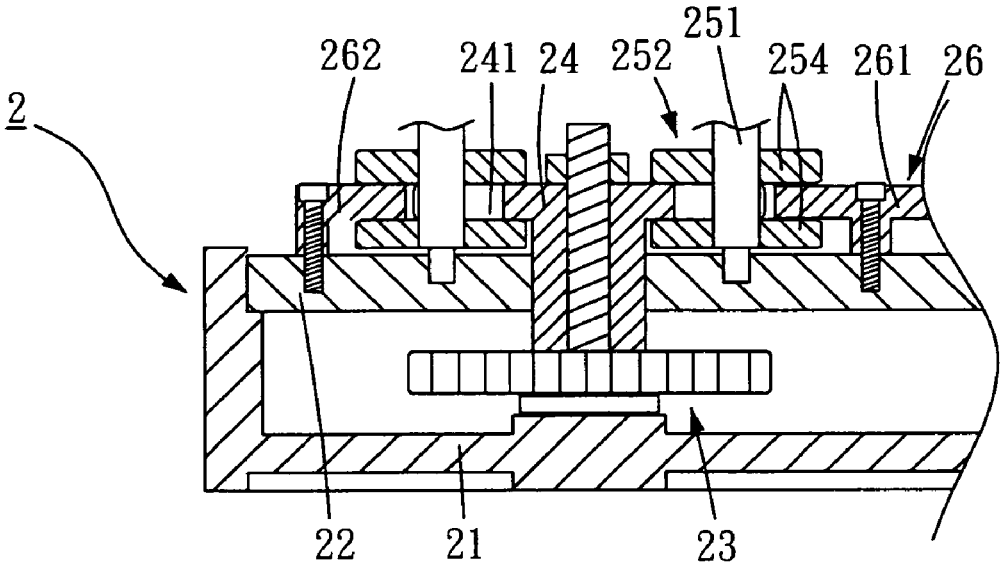
FIG. 4 is a cross sectional view to show that the support plates are movably engaged with the center guide member and the outer guide member of the guiding device.

Referring to FIGS. 2 to 4, the braiding machine 2 of the present invention comprises a base 21 with a transmission device 23 received therein which includes a plurality of gears. A cover 22 is mounted on the base 21 and a plurality of transfer plates 24 are located on the cover 22 and driven by the transmission device 23. Each of the transfer plates 24 has a plurality of notches 241. A carrier 25 is movably located on the cover 22 and driven by the transfer plates 24 and has a shaft 251. A support mechanism 252 is located on a side of the shaft 251 of the carrier 25 and a weaving mechanism 253 is located on the other side of the shaft 251. The support mechanism 252 includes two support plates 254 which are located on an upper surface and a bottom surface of the transfer plates 24.

Figure 5:
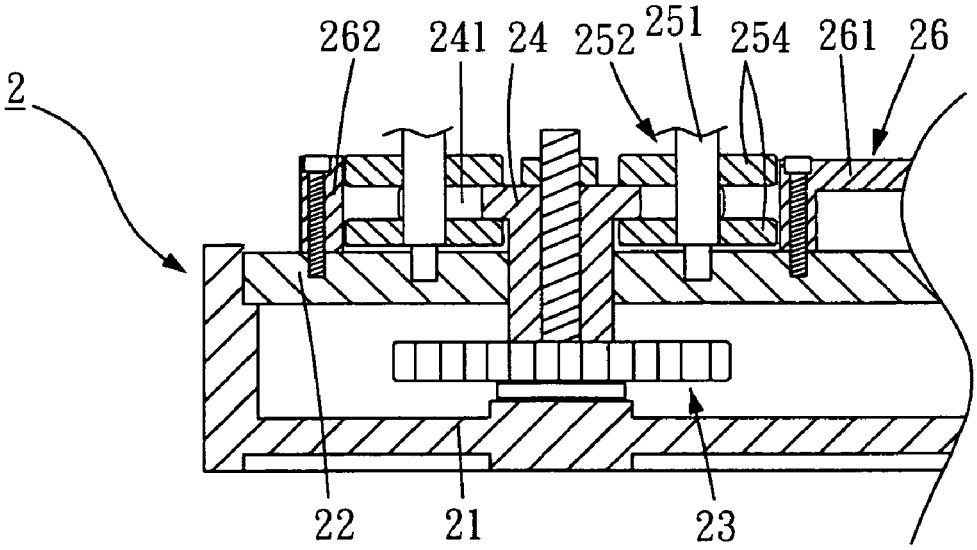
FIG. 5 is a cross sectional view to show another embodiment of the guiding device and the engagement between the support plates and the center guide member and the outer guide member of the guiding device.

A guiding device 26 is mounted above the cover 22 and includes a center guide member 261 and an outer guide member 262. Each of the center guide member 261 and the outer guide member 262 is supported at a height above the top surface of the guiding device 26. The transfer plates 24 are located between the center guide member 261 and the outer guide member 262. The center guide member 261 and the outer guide member 262 are inserted between the two support plates 254 as shown in FIG. 4. To work the carrier braiding machine, the transmission device 23 drives the transfer plates 24 and the transfer plates 24 drives carrier 25 to rotate around the transfer plates 24. When the carrier 25 rotates, the center guide member 261 and outer guide member become a protection to prevent the carrier 25 from fly away from the transfer plates by eccentric force. FIG. 5 shows a second embodiment of the guiding member 26 wherein the center guide member 261 and the outer guide member 262 are in contact with an outer periphery of each of the two support plates 254, and have the same height as the two support plates 254.

The guiding device 26 maintains the carrier 25 at operation area and the eccentric force cannot push the carrier 25 away from the transfer plates 24. Besides, the spinning speed of the carrier 25 is reduced because the carrier 25 is in contact with the center guide member 261 and the outer guide member 262. Accordingly, the torque applied to the shaft 251 can be reduced and the term of use of the carrier 25 can be prolonged.

While we have shown and described the embodiment in accordance with the present invention, it should be clear to those skilled in the art that further embodiments may be made without departing from the scope of the present invention.

What is claimed is:

1. A carrier braiding machine comprising:

a base;

a cover mounted on the base;

a transmission device received in the base;

a plurality of transfer plates with a plurality of notches located on a top surface of the cover and driven by the transmission device;

a carrier engaged by the transfer plates above the top surface of the cover to be responsively advanced in guided manner therealong, the carrier having a shaft, a support mechanism located on a side of the shaft and a weaving mechanism located on the other side of the shaft, the support mechanism including two support plates disposed about upper surface and a bottom surfaces of the transfer plates; and a guiding device mounted above the cover and including a center guide member and an outer guide member, the transfer plates and the support plates being located between the center guide member and the outer guide member, the support plates being movably captured by the transfer plates and at least one of the center guide and outer guide members.

2. The machine as claimed in claim 1, wherein the center guide member and the outer guide member are configured for at least partial insert between the two support plates of the carrier.

3. The machine as claimed in claim 1, wherein the center guide member and the outer guide member are in contact with an outer periphery of each of the two support plates.

4. The machine as claimed in claim 3, wherein the center guide member and the outer guide member have the same height as the two support plates.

* * * * *